United States Patent [19]

Fleischer

[11] 4,273,994

[45] Jun. 16, 1981

[54] ROTARY ELECTROMAGNETIC INDICATOR

[75] Inventor: Donald W. Fleischer, Wethersfield, Conn.

[73] Assignee: Veeder Industries Inc., Hartford, Conn.

[21] Appl. No.: 104,045

[22] Filed: Dec. 17, 1979

[51] Int. Cl.[3] ..... G06M 1/10

[52] U.S. Cl. ..... 235/92 A

[58] Field of Search ..... 235/92 A, 92 FL, 92 MP; 340/319, 378.5; 310/156

[56] References Cited

U.S. PATENT DOCUMENTS

| | | | |
|---|---|---|---|
| 3,732,561 | 5/1973 | McGinnis | 340/378.5 |
| 4,071,742 | 1/1978 | Fleischer | 235/92 A |
| 4,125,762 | 11/1978 | Fleischer | 235/92 FL |

*Primary Examiner*—Joseph M. Thesz

*Attorney, Agent, or Firm*—Prutzman, Kalb, Chilton & Alix

[57] ABSTRACT

A rotary electromagnetic decade indicator having a permanent magnet rotor with ten alternating north and south salient poles, a salient pole stator with primary and secondary salient poles in one-half digit out of phase relationship and a master salient pole with a relatively wide pole face with sections thereof in full digit phase relationship with the primary and secondary poles and a stator winding on the master pole for magnetizing the master pole in either direction and the remaining primary and secondary salient poles in the opposite direction for stepping the rotor one count.

9 Claims, 2 Drawing Figures

ROTARY ELECTROMAGNETIC INDICATOR

DESCRIPTION

Technical Field & Background Art

The present invention relates generally to rotary electromagnetic indicators of the type disclosed in my U.S. Pat. No. 4,125,762, dated Nov. 14, 1978 and entitled "Rotary Electromagnetic Indicator System" and more particularly to a new and improved rotary electromagnetic indicator having notable utility in fuel dispensing apparatus for registering the volume and/or cost amout of fuel delivered.

Disclosure of Invention

It is a primary aim of the present invention to provide a new and improved rotary electromagnetic indicator for fuel dispensing apparatus providing improved operation and reliability in the registration of the volume and/or cost amount of fuel delivered.

It is another aim of the present invention to provide a new and improved relatively low cost and high speed rotary electromagnetic decade counter.

It is a further aim of the present invention to provide a new and improved rotary electromagnetic indicator for counting and indicating systems for being electromagnetically indexed for accumulating and registering a count.

It is a further aim of the present invention to provide a new and improved rotary electromagnetic indicator having uniform and reliable operation over a wide range of operating temperature and voltage.

It is a further aim of the present invention to provide a new and improved reset mechanism for a rotary electromagnetic decade indicator for resetting the decade indicator to "0" or other predetermined reset position.

It is a further aim of the present invention to provide a new and improved rotary electromagnetic indicator having a permanent magnet indicating rotor and a stator with a stator core with an annular arrangement of a plurality of salient poles and a drive coil adapted to be selectively energized for magnetically indexing the rotary indicator in one angular direction.

It is another aim of the present invention to provide a new and improved rotary electromagnetic indicator operable at a relatively high effective indexing rate.

It is another aim of the present invention to provide a new and improved rotary electromagnetic indicator operable at a high indexing rate from each indicating position to a succeeding rest indicating position without substantial wheel overshoot or oscillation at the succeeding position.

It is another aim of the present invention to provide a new and improved single wheel rotary indicator module usable alone or in a bank thereof as a numeral display, decade counter or the like.

Other objects will be in part obvious and in part pointed out more in detail hereinafter.

A better understanding of the invention will be obtained from the following detailed description and the accompanying drawings of an illustrative application of the invention.

BEST MODE FOR CARRYING OUT THE INVENTION

Figure 2:
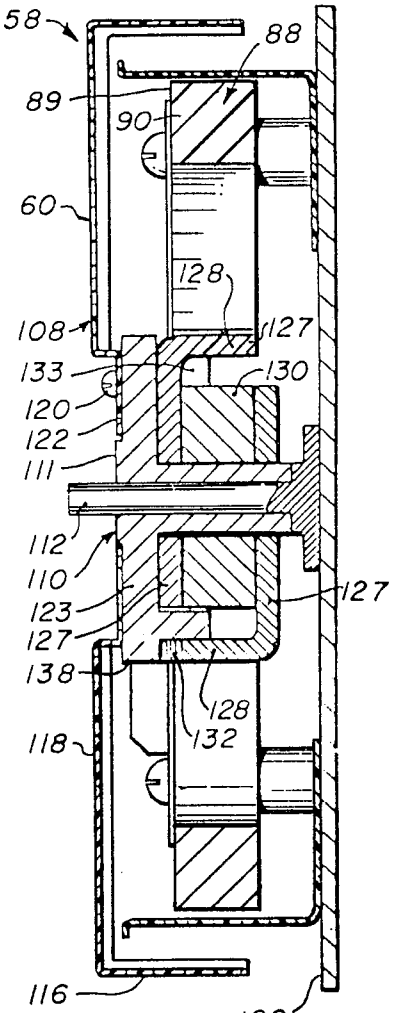
FIG. 2 is a front elevation section view, partly broken away and partly in section, of the indicator module.

Referring now to the drawing in detail wherein like reference numerals indicate like parts, there is shown a rotary electromagnetic indicator or decade module 58 which incorporates an embodiment of the present invention. The decade module 58 is generally constructed like the decade module shown and described in my aforementioned U.S. Pat. No. 4,125,762 and is designed for use in fuel pump indicator systems for registering the cost and/or volume of fuel dispensed as disclosed in U.S. Pat. No. 4,125,762. A fuel pump indicator system which employs the decade module 58 is not shown and described herein but may be generally like that disclosed in U.S. Pat. No. 4,125,762 as necessarily modified to employ the decade module 58 of the present invention.

The rotary electromagnetic indicator or decade module 58 has a ten position 0–9 number or decade wheel 60, and for example a bank of five of the decade module 58 can be employed to provide a five wheel cost or volume counter as described in U.S. Pat. No. 4,125,762.

The rotary number wheel 60 is adapted to be selectively electromagnetically stepped to each of its ten "0" through "9" equiangularly spaced count positions in sequence. For that purpose, the rotary decade module 58 comprises a stator 88 having a generally flat stator core 89 with an outer circular ring 90 and six angularly spaced radially inwardly extending salient poles 92–97. A single operating winding or coil 98 is mounted on the salient pole 95, and therefore the salient pole 95 functions as a master control pole for the stator. For a reason explained hereinafter, master control pole 95 has a relative wide pole face which is preferably 36° wide, whereas each of the remaining stator poles 92–94, 96 and 97 has a relatively narrow pole face which is preferably 18° wide. The stator core 89 (which, for example, may be made of flat soft iron laminations) is mounted on a frame 100, and a suitable electrical connector 102 mounted on a rear flange 104 of the frame 100 is provided for electrical connection to the two leads of the stator coil 98.

The rotary decade module 58 has a rotor 108 with a central permanent magnet hub assembly 110 with a plastic support hub 111 rotatably mounted on a stub shaft 112 secured to the frame 100. The number wheel 60 of the rotor 108 is formed of thin plastic with an outer 0–9 numeral bearing rim 116 encircling the stator ring 90 and an intermediate web 118 secured by fasteners 120 to an outer end face 122 of a generally circular end flange 123 of the support hub 111.

A pair of identical axially spaced and oppositely facing coaxial pole pieces 127 are mounted on the plastic support hub 111. Each of the pole pieces 127 has five equiangularly spaced (i.e., 72° spaced) axially extending segments or poles 128, each preferably having an 18° wide pole face, and the two pole pieces 127 are mounted on the support hub 111 to provide an annular arrangement of ten equiangularly spaced poles 128. A circular axially magnetized permanent magnet 130 is mounted coaxially between and in engagement with the pole pieces 127 so that the five poles 128 of each pole piece 127 have the same polarity and the ten poles of the annular pole arrangement have alternating polarity. The support hub 111 is molded with ten equiangularly spaced slots 132, 133 in the end flange 123 for receiving and thereby angularly retaining the poles 128 of the two pole pieces 127 respectively. The inner pole piece 127 is press fit onto the plastic support hub 111, and the circular permanent magnet 130 and outer pole piece 127 are axially retained in assembled condition by the magnetic attraction of the intermediate permanent magnet 130 and oppositely facing pole pieces 127.

Figure 1:
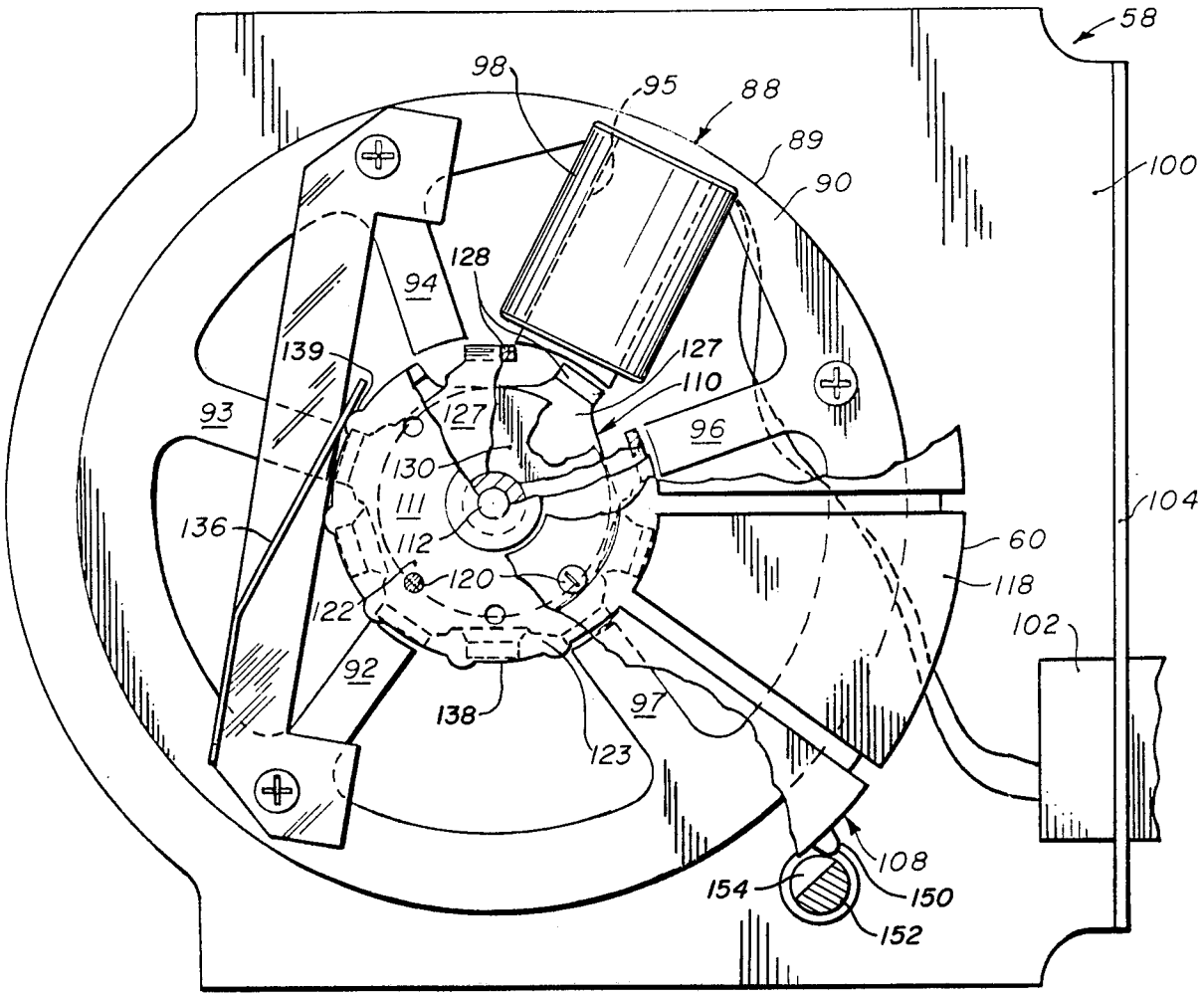
FIG. 1 is an elevation side view, partly broken away and partly in section, of a rotary electromagnetic indicator module incorporating an embodiment of the present invention.

The number wheel 60 is electromagnetically indexed in the forward or additive direction, in the clockwise direction as viewed in FIG. 1, by the selective energization of the drive coil 98 to index the number wheel 60 in stepwise fashion in the manner of a digital counter wheel. A damping shoe 136 provided in the form of a light leaf spring is mounted on the stator core ring 90 for engagement with a peripheral cam edge 138 on the end flange 123 of the support hub 111. The cam edge 138 is shown having ten equiangularly spaced (i.e., 36° spaced) radially projecting rise portions 139 which are individually engageable by the shoe 136 as the wheel 60 is rotated in the forward or additive angular direction to each full count position. Alternatively, a smooth circular cam edge (not shown) could be employed for continuous light frictional engagement by the shoe 136. In either case, the shoe engagement with the cam is established for frictionally damping any wheel oscillation and overshoot at each full count position. Also, in each full count position of the wheel 60, one of the ten rotor poles 128 of one polarity is radially aligned with the leading one-half or 18° pole face section of the relatively wide master salient pole 95, and four other rotor poles 128 of opposite polarity (i.e., on the other pole piece 127) are radially aligned with four slave salient poles 92, 93, 96 and 97 of the stator and for which purpose, those slave stator poles 92, 93, 96 and 97 have a 72° angular spacing. That group of four slave salient poles 92, 93, 96 and 97 therefore provide in combination with the master salient pole 95, a magnetic circuit hereinafter referred to as the "primary" magnetic circuit for magnetically attracting the rotor to and detenting it at each full count position. And, even with the stator operating coil 98 de-energized, the master and four slave stator poles 92, 93, 95, 96 and 97 provide an effective and preferred magnetic detent for holding the number wheel 60 at each full count position. Accordingly, the operating coil 98 can be and is preferably maintained de-energized between counts to save power. Such is particularly beneficial in a loss of power condition for eliminating the need for a backup battery power source. The remaining slave salient pole 94 of the stator is angularly positioned 36° or one full count from the trailing or counter-clockwise one-half or 18° pole face section of the master salient pole 95. Therefore, that slave salient pole 94 is one-half count or 18° out of phase with (and also generally diametrically opposed to) the group of four stator poles 92, 93, 96 and 97 of the "primary" magnetic circuit. Accordingly, the slave salient pole 94 forms with the master salient pole 95, a "secondary" magnetic circuit which is one-half count out of phase with the "primary" magnetic circuit. Thus, upon energization of the operating coil 98 in the appropriate direction, the "secondary" magnetic circuit comprising the master pole 95 and the slave pole 94 provides for steering the rotor in the forward or additive angular direction, in the clockwise angular direction as viewed in FIG. 1, from each prior full count position toward the succeeding full count position. Also, all of the salient poles of the rotor cooperate to rotate the rotor toward an intermediate or one-half count position where the slave pole is aligned with a rotor pole of opposite polarity. Thereafter, the forward momentum of the wheel 60 and the group of four slave poles 92, 93, 96 and 97 of the "primary" magnetic circuit continue to rotate the rotor against the opposing but lower magnetic force of the "secondary" magnetic circuit to complete the forward indexing step to the succeeding full count position.

Each wheel indexing step is effected by energizing the drive coil 98 (in an appropriate direction corresponding to the existing wheel position) for a time interval (e.g., 50 milliseconds) sufficient to index the wheel 60 one full count. During a full count indexing step the number wheel 60 is initially accelerated from the prior full count position to the one-half count position midway between the prior and succeeding full count positions. The drive coil 98 is maintained energized for continuing the rotation of the rotor and to decelerate the rotor to a stop at its succeeding count position, and the drive coil 98 is deenergized to terminate the wheel indexing cycle after the wheel 60 is correctly located at its succeeding count position by the "primary" magnetic circuit. As previously indicated, the leaf spring damping shoe 136 engages a cam projection 139 to frictionally reduce wheel oscillation and overshoot at its succeeding full count position to minimize the stepping cycle interval.

Thus, the number wheel 60 is indexed one count by establishing the operating polarity of the master salient pole 95 with the drive coil 98 in accordance with the polarity of the adjacent rotor pole 128 and therefore the existing count position of the number wheel. Thus, for example, the drive coil 98 is energized to establish a North operating polarity for indexing the rotor in the additive or forward angular direction from an odd to an even count position and is energized to establish a South operating polarity for indexing the rotor in the forward angular direction from an even to an odd count position. If the coil is energized to establish the reverse operating polarity (i.e., a South polarity with the number wheel in the odd count position or a North polarity with the number wheel in the even count position) the counter wheel 60 will be held at the existing count position by the "primary" magnetic circuit. Therefore, the counter wheel is adapted to be indexed in only the forward or desired direction and only one count for each energization cycle of the drive coil 98.

It can be seen that during each count cycle, the "secondary" magnetic circuit slave pole 94 opposes the continuing rotation of the rotor beyond the one-half count position and thereby assists in decelerating the rotor to its full count position to which it is attracted and retained by the "primary" magnetic circuit. Also, the "primary" magnetic circuit provides for ensuring that the rotor is brought to rest at its succeeding full count position at the end of each count cycle. Thus, the stator operating coil 98 is preferably energized sufficiently long to index the wheel to each successive count position and until the wheel 60 is magnetically locked in the full count position by the preferred magnetic detenting provided by the "primary" magnetic circuit. Also, as there is only one slave stator pole 94 in the "secondary" magnetic circuit, the four slave stator poles 92, 93, 96 and 97 of the "primary" magnetic circuit will dominate the detenting function and ensure that the wheel remains centered at each count position at the end of a count cycle.

For resetting the number wheel 60 to its "0" count position, the counter wheel 60 is indexed in the forward or additive angular direction as described until a rasised abutment 150 on the number wheel 60 engages a transverse rotary abutment shaft 152. The rotary abutment shaft 152 is formed with a peripheral slot 154 for receiving the raised abutment 150 during normal operation of the counter wheel and thereby permit continuous rotation of the number wheel. For resetting the wheel, the rotary abutment shaft 152 is rotated for example 180° to shift the shaft into position for engagement by the raised abutment 150 on the number wheel 60 for stopping the number wheel 60 at its "0" position.

Where a plurality of decade modules 58 are mounted in a bank to provide a decade counter as shown and described in U.S. Pat. No. 4,125,762, a single rotary abutment shaft 152 is preferably employed for all of the decade modules 58 of the bank and having a similar peripheral slot 154 for each of the number wheels 60 and whereby all of the number wheels 60 of the decade module bank can be reset together to "0". It is also contemplated that where two or more banks of the decade modules are employed for example in a fuel pump indicator system as shown and described in U.S. Pat. No. 4,125,762, the abutment shafts of all of the decade module banks would be mechanically interconnected and rotated together, for example by a solenoid.

As will be apparent to persons skilled in the art, various modifications, adaptations and variations of the foregoing specific disclosure can be made without departing from the teachings of the present invention.

I claim:

1. In a rotary electromagnetic indicator comprising an indicating rotor with an even plurality of equiangularly spaced digital indicating positions and having a permanent magnet with an annular arrangement of an even plurality of alternating north and south salient poles for said plurality of equiangularly spaced digital indicating positions respectively, and a stator with a stator core with a plurality of angularly spaced salient poles, each adapted to be aligned with each pole of the rotor permanent magnet as the indicating rotor is rotated by the stator in a forward angular direction through 360°; the improvement wherein the salient poles of the stator core comprises a master salient pole with forward and rearward angular pole face sections in approximately one-half digit out of phase relationship and first and second groups of salient poles with respective pole faces in approximately one-half digit out of phase relationship, each pole face of the first salient pole group being angularly spaced from the rearward pole face section of the master salient pole for respective alignment with rotor poles of opposite polarity, the second salient pole group having at least one more salient pole than the first group, and each pole face of the second pole group being angularly spaced from the forward pole face section of the master salient pole for respective alignment with rotor poles of opposite polarity, and a stator coil winding on the master salient pole for selectively magnetizing the master salient pole in each direction and the remaining salient poles of the stator in the opposite direction for indexing the rotor one digit in said forward angular direction.

2. A rotary electromagnetic indicator according to claim 1 wherein the first pole group comprises only one salient pole.

3. A rotary electromagnetic indicator according to claim 1 wherein the second pole group comprises four salient poles.

4. A rotary electromagnetic indicator according to claim 1 wherein the indicating rotor comprises an annular arrangement of ten salient poles for angularly positioning the indicating rotor in each of ten equiangularly spaced digital indicating positions.

5. A rotary electromagnetic indicator according to claim 1 wherein the stator core comprises an annular ring generally coaxial with the indicating rotor and wherein the salient poles of the stator extend radially inwardly from the annular ring within a plane generally normal to the axis of the indicating rotor.

6. A rotary electromagnetic indicator according to claim 1, 2, 3, 4 or 5 wherein the master salient pole has a continuous pole face, forming said forward and rearward angular pole face sections, with an angular width at least approximately equal to the angular spacing between digital indicating positions.

7. A rotary indicator according to claim 1, 2, 3, 4 or 5 wherein the salient poles of the rotor and the first and second groups of salient poles of the stator have respective pole faces with an angular width approximately equal to one-half the angular spacing between digital indicating positions.

8. A rotary electromagnetic indicator according to claim 1 further comprising reset abutment means selectively operable for preventing rotation of the indicating rotor in said one angular direction past a predetermined digital indicating position.

9. In a rotary electromagnetic indicator comprising an indicating rotor with an even plurality of equiangularly spaced digital indicating positions and having a permanent magnet with an annular arrangement of an even plurality of alternating north and south salient poles for said plurality of equiangularly spaced digital indicating positions respectively, and an electromagnetic stator with a stator core having an annular ring and a plurality of angularly spaced salient poles with pole faces within a plane generally normal to the axis of the indicating rotor, each of the salient poles of the stator being adapted to be aligned with each pole of the rotor permanent magnet as the indicating rotor is rotated in a forward angular direction through 360° by electromagnetic operation of the stator; the improvement wherein the plurality of salient poles of the stator comprises a master salient pole with forward and rearward angular pole face sections and first and second groups of slave salient poles with respective pole faces in approximately one-half digit out of phase relationship, the first group having at least one slave salient pole with a pole face angularly spaced from the rearward pole face section of the master salient pole for respective alignment with rotor poles of opposite polarity, the second group having at least one more slave salient pole than the first group and with their pole faces angularly spaced from the forward pole face section of the master salient pole for respective alignment with rotor poles of opposite polarity, and a salient pole winding on said stator core for magnetizing the stator core to provide one magnetic polarity at the master pole face sections and the opposite polarity at the remaining slave pole faces and operable for digitally indexing the indicating rotor in said forward angular direction from each rest digital indicating position thereof to its succeeding digital indicating position by energizing the winding for a controlled time interval and in a controlled direction.

* * * * *